US006703982B2

(12) United States Patent
Park

(10) Patent No.: US 6,703,982 B2
(45) Date of Patent: Mar. 9, 2004

(54) CONFORMAL TWO DIMENSIONAL ELECTRONIC SCAN ANTENNA WITH BUTLER MATRIX AND LENS ESA

(75) Inventor: Pyong K. Park, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/935,148

(22) Filed: Aug. 22, 2001

(65) Prior Publication Data

US 2003/0038752 A1 Feb. 27, 2003

(51) Int. Cl.[7] ..... H01Q 3/00; H01Q 13/12
(52) U.S. Cl. ..... 343/757; 343/769
(58) Field of Search ..... 343/753, 754, 343/757, 758, 763, 769, 770

(56) References Cited

U.S. PATENT DOCUMENTS 3,979,754 A * 9/1976 Archer ..... 343/754
4,323,901 A * 4/1982 De Wames et al. ..... 343/754
4,447,815 A * 5/1984 Chekroun et al. ..... 343/754
4,975,712 A * 12/1990 Chen ..... 343/754
5,729,239 A * 3/1998 Rao ..... 343/753

* cited by examiner

*Primary Examiner*—Hoang Nguyen
(74) *Attorney, Agent, or Firm*—Thomas J. Finn; Colin M. Raufer; Glenn H. Lenzen, Jr.

(57) ABSTRACT

An antenna and antenna excitation method. The inventive antenna includes a cylindrical array (20) of radiating elements. Each of the elements is mounted at a predetermined substantially transverse angle relative to a longitudinal axis. A circuit (30) is included for providing an electrical potential between at least two of the elements effective to scan a transmit or a receive beam of electromagnetic energy along an elevational axis at least substantially transverse to the longitudinal axis. In the illustrative embodiment, the array includes a stack of the planar, parallel, conductive, ring-shaped radiating elements, each of which is filled with ferroelectric bulk material. A second circuit (70) is included for exciting at least some of the elements to cause the elements to generate a transmit or a receive beam of electromagnetic energy off-axis relative to the longitudinal axis. In the preferred embodiment, the second circuit is a Butler matrix and is effective to cause the beam to scan in azimuth about the longitudinal axis, the azimuthal axis being at least substantially transverse to the longitudinal axis and the elevational axis.

43 Claims, 8 Drawing Sheets

CONFORMAL TWO DIMENSIONAL ELECTRONIC SCAN ANTENNA WITH BUTLER MATRIX AND LENS ESA

BACKGROUND OF THE INVENTION

1. Field of the Invention

The present invention relates to antennas. More specifically, the present invention relates to electronically scanned antennas.

2. Description of the Related Art

Seekers are used to sense electromagnetic radiation. For certain applications, there is a requirement for at least two seekers. For example, in the missile art, there is a need for an infrared (IR) seeker and a radio frequency (RF) seeker. As both seekers must be mounted in the nose of the missile, one typically at least partially obscures the field of view of the other. The IR seeker not only creates a blind spot for the RF seeker, but also, degrades the field radiation pattern of the antenna thereof.

The situation is exacerbated by the fact that there is a trend toward the use of higher frequency seekers to achieve higher levels of performance in target detection and discrimination. While current RF seekers operate in the X band (8 to 12 GHz), these newer seekers are planned to operate in the Ka band or the W band (27 to 40 GHz). However, a need would remain for the X band capability. Hence, two antennas are required giving rise to the aforementioned problem of occlusion.

Accordingly, there is a need in the art for a system or method for integrating two or more seekers into a single housing in such a manner that neither seeker interferes with the operation of the other.

SUMMARY OF THE INVENTION

The need in the art is addressed by the antenna and antenna excitation method of the present invention. The inventive antenna includes an array of radiating elements, each of the elements being mounted at a predetermined substantially transverse angle relative to a longitudinal axis and a circuit for providing an electrical potential between at least two of the elements effective to scan a transmit or a receive beam of electromagnetic energy along an elevation axis at least substantially transverse to the longitudinal axis.

In the illustrative embodiment, the array includes a stack of the planar, parallel, conductive, ring-shaped radiating elements, each of which is filled with ferroelectric bulk material. Space matching material is disposed on the inner and outer periphery of each element.

A second circuit is included in the specific implementation for exciting at least some of the elements to cause the elements to generate a transmit or a receive beam of electromagnetic energy off-axis relative to the longitudinal axis. In the preferred embodiment, the second circuit is a Butler matrix and is effective to cause the beam to scan in azimuth about the longitudinal axis, the azimuthal axis being at least substantially transverse to the longitudinal axis and the elevational axis.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
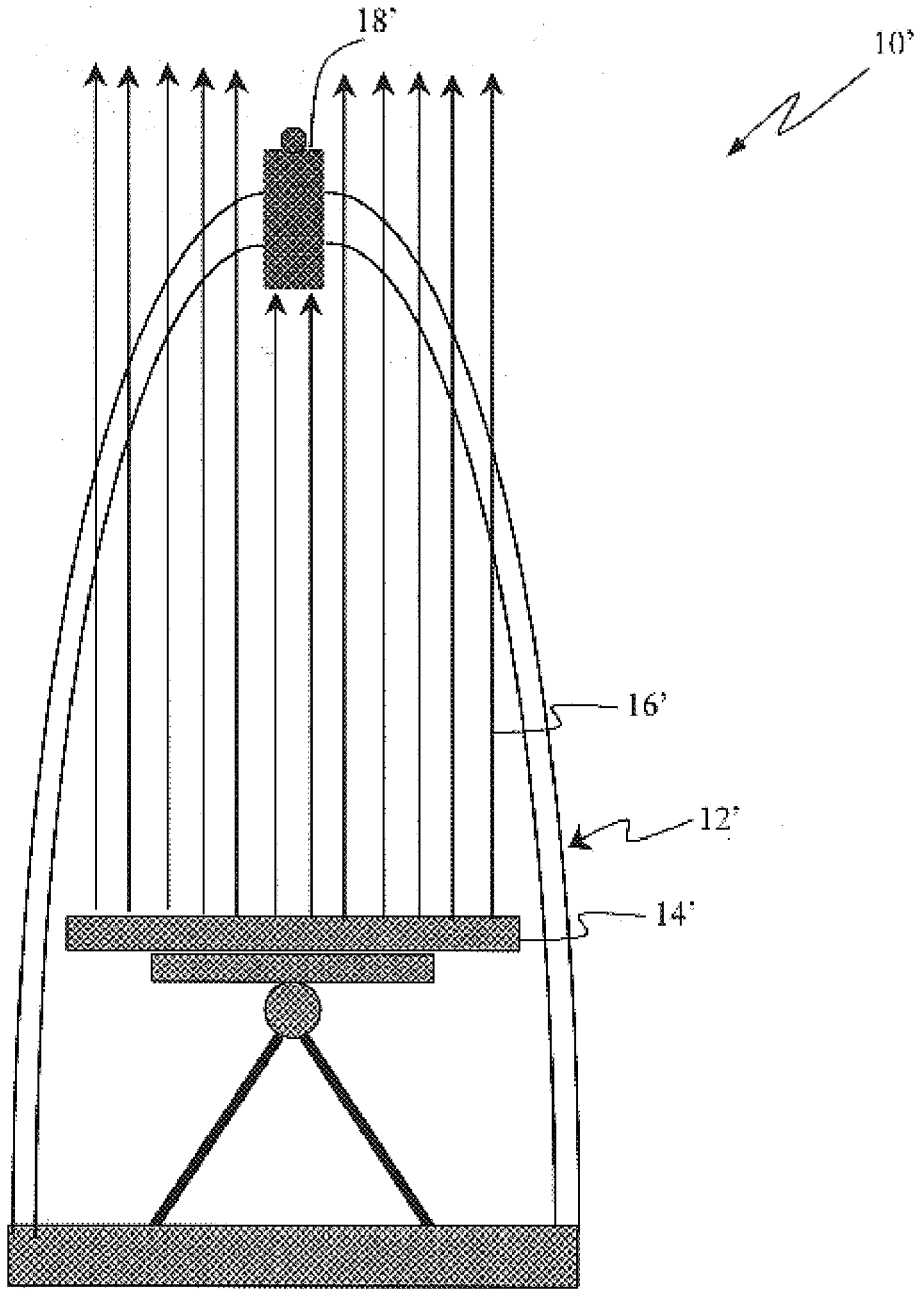
FIG. 1 is a simplified sectional view of a nose cone of multi-mode missile constructed in accordance with conventional teachings.

FIG. 1 is a simplified sectional view of a nose cone of multi-mode missile constructed in accordance with conventional teachings. As shown in FIG. 1, the missile 10' has a nose cone 12' within which an RF seeker 14' is mounted. Electromagnetic energy 16' radiated (or received) by the seeker 14' is at least partially blocked by an IR seeker 18' disposed at the distal end of the nose cone 12'. Hence, FIG. 1 illustrates the need in the art for a system or method for integrating two or more seekers into a single housing in such a manner that neither seeker interferes with the operation of the other.

As mentioned above, the need in the art is addressed by the antenna and antenna excitation method of the present invention. As discussed more fully below, the inventive antenna includes an array of radiating elements, each of the elements being mounted at a predetermined, substantially transverse, angle relative to a longitudinal axis and a circuit for providing an electrical potential between at least two of the elements effective to scan a transmit or a receive beam of electromagnetic energy along an elevation axis at least substantially transverse to the longitudinal axis. In the illustrative embodiment, the array includes a stack of the planar, parallel, conductive, ring-shaped radiating elements, each of which is filled with ferroelectric bulk material. Space matching material is disposed on the inner and outer periphery of each element. A second circuit is included in the specific implementation for exciting at least some of the elements to cause the elements to generate a transmit or a receive beam of electromagnetic energy off-axis relative to the longitudinal axis. In the preferred embodiment, the second circuit is a Butler matrix and is effective to cause the beam to scan in azimuth about the longitudinal axis, the azimuthal axis being at least substantially transverse to the longitudinal axis and the elevational axis.

Figure 2:
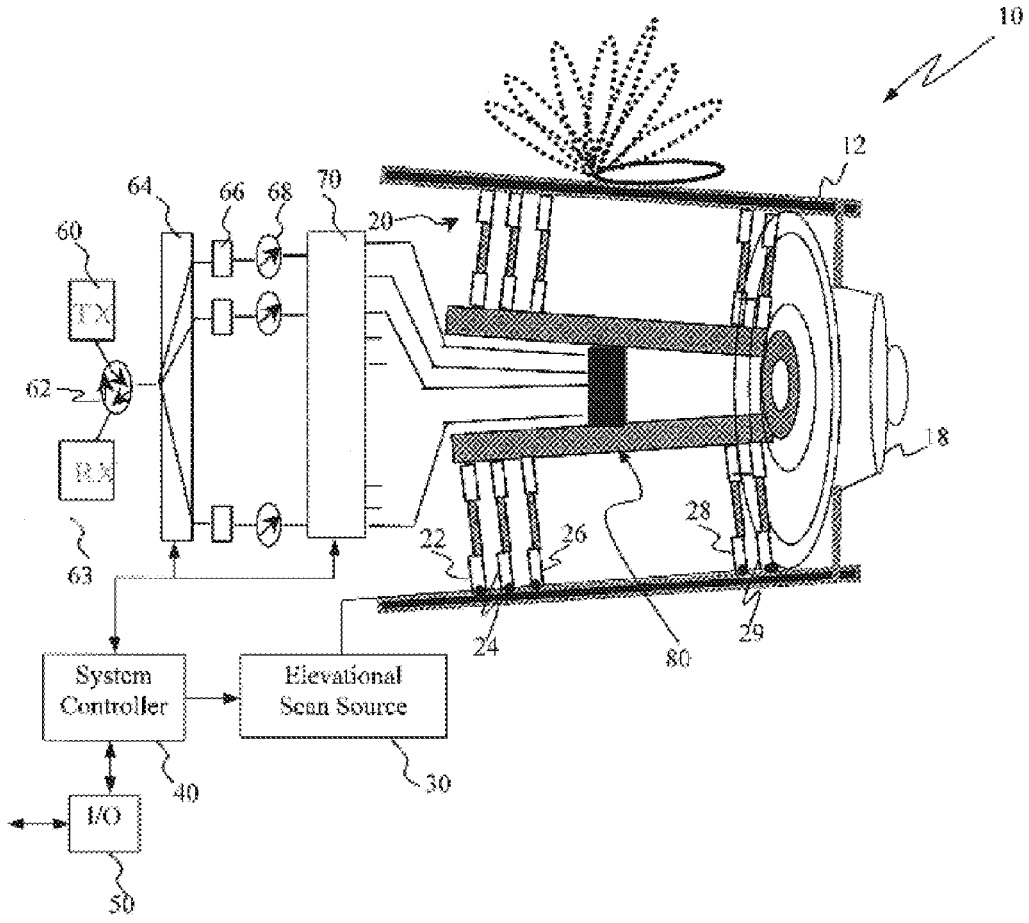
FIG. 2 is a block diagram of a multi-mode antenna constructed in accordance with the teachings of the present invention.

FIG. 2 is a block diagram of a multi-mode antenna constructed in accordance with the teachings of the present invention. The antenna 10 includes a conformal (body-fixed) phased array of radiating elements 20.

Figure 3:
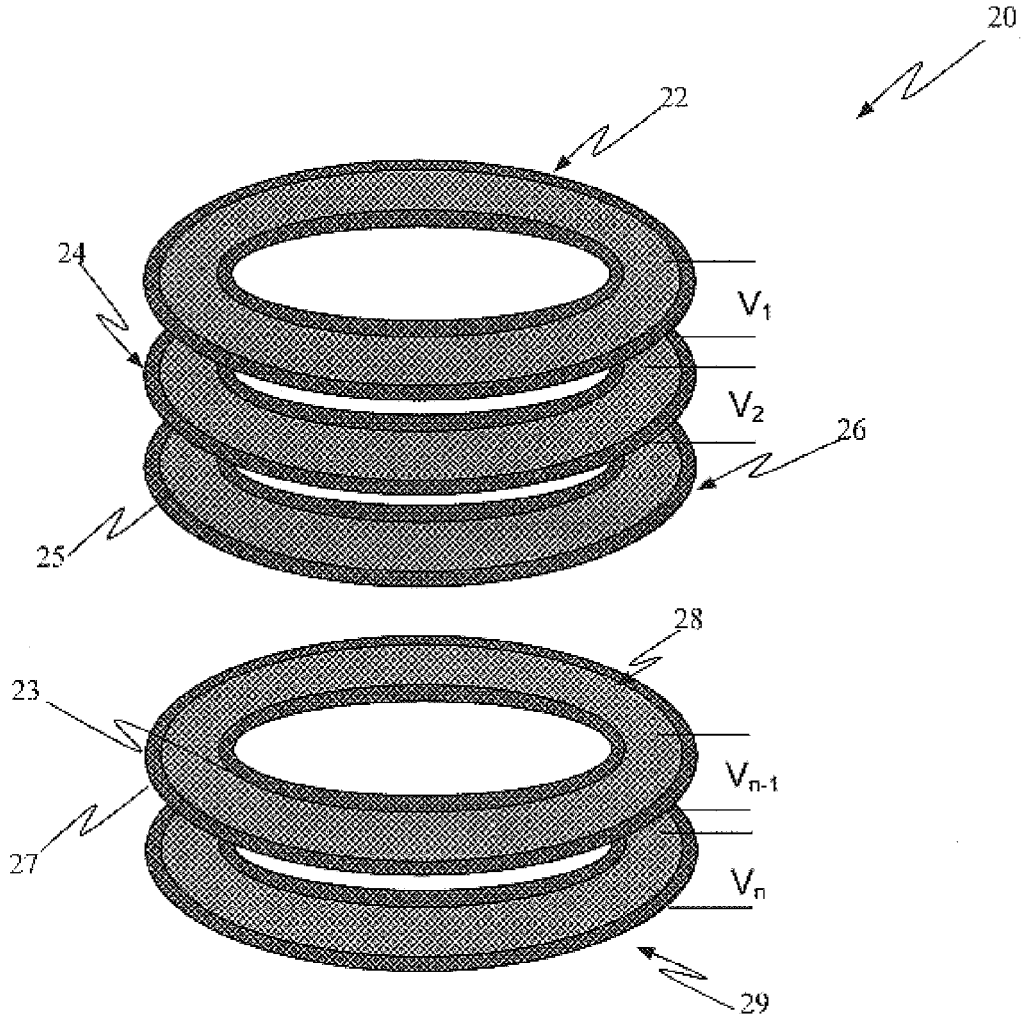
FIG. 3 is a simplified disassembled perspective side view of the lens array of FIG. 2.

FIG. 3 is a simplified disassembled perspective side view of the lens array of FIG. 2. The principal element of the lens array 20 is a TEM mode transmission line that has a parallel plates filled with ferroelectric bulk material. For a conformal array, the lens array 20 is a cylindrical shape. As shown in FIG. 3, the array 20 includes a stack of planar, parallel, ring-shaped plates of conductive material of which n are shown in FIG. 3 (22, 24, 26, 28 and 29). In the illustrative embodiment, the plates are made of gold or other suitable conductor.

Figure 4:
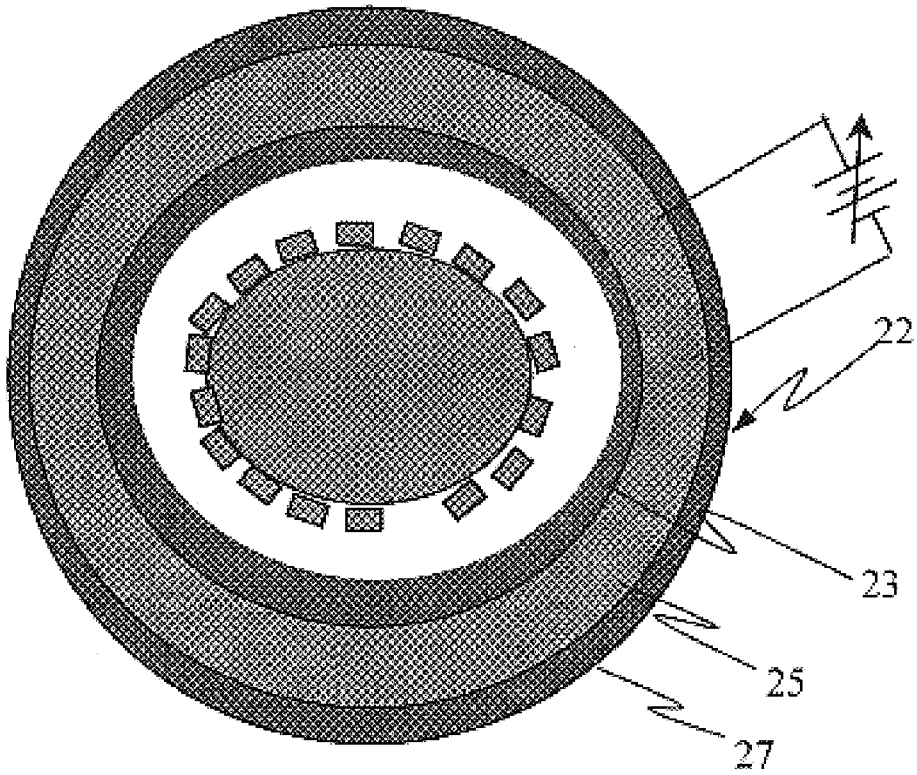
FIG. 4 is a top view of a single radiating element of the array depicted in FIG. 3.

FIG. 4 is a top view of a single radiating element of the array depicted in FIG. 3. As illustrated in FIGS. 3 and 4, the plates are filled with ferroelectric material 23 and include an inner ring 25 and an outer ring 27 which provide space matching transformers. The dielectric constant of a ferroelectric material changes with the applied DC bias voltage and the phase of RF wave passing through the lens array changes as a function of the applied DC bias voltage. Hence, the stacked cylindrical lens elements will scan in elevation by setting proper DC biases to the cylindrical lens elements.

Figure 5:
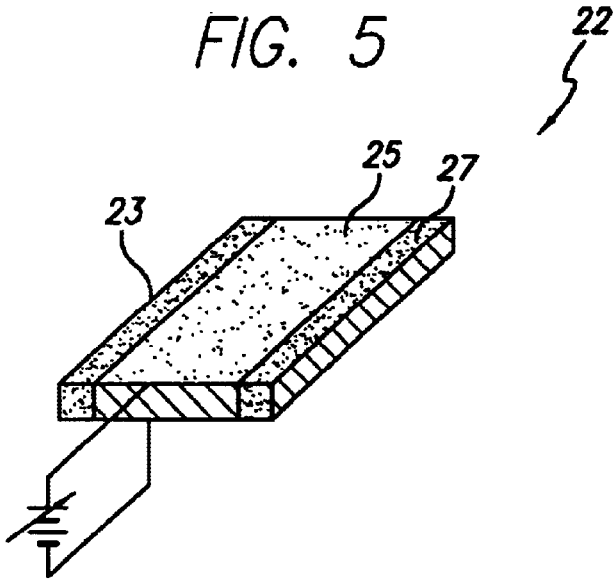
FIG. 5 is a sectional side view of a portion of the plate depicted in FIG. 4.

FIG. 5 is a sectional side view of a portion of the plate depicted in FIG. 4. The space matching transformers may be made of high dielectric material or parallel plates. The function of the space matching elements is to radiate all the RF energy to the space. Those skilled in the art will appreciate that the invention is not limited to the size, shape, number or construction of the radiating elements 22, 24, 26, 28 and 29. Numerous other designs may be used for various applications.

As will be appreciated by one of ordinary skill in the art, the use of ferroelectric material is advantageous in that on the application of an applied DC voltage, the dielectric constant of the material changes and effects a change in the elevation of the output beam radiated from the element as illustrated in FIG. 3. That is, the microwave propagation velocity in the parallel plates varies as a function of the DC voltage bias between plates, as the dielectric constant of the ferroelectric material varies accordingly. As a result, the phase of an incoming RF signal is changed by the lens element according to its DC bias. When a stacked array of lens elements are biased with a proper set of DC bias voltages and are fed by a planar array, the output of the array will be scanned in one dimension.

Typical ferroelectric materials include BST (beryllium, strontium tetanate composit, liquid crystals, etc.). Those skilled in the art will appreciate that the present invention is not limited to the use of ferroelectric material in the radiating elements. Any arrangement that provides a change in the elevational angle of an output beam, in response to an applied voltage may be used without departing from the scope of the present teachings.

Returning to FIG. 2, the voltage differential $V_n$ between the plates is supplied by a source 30. In practice, the source 30 may be a power divider circuit, a digitally controlled power supply or other suitable arrangement. The source is controlled by a system controller 40 in response to inputs received via an input/output circuit 50.

Scanning of the output beam in azimuth is effected through the use of a multi-beam (e.g. Butler matrix) circuit as discussed more fully below.

As shown in FIG. 2, a transmit signal from an RF transmitter (e.g. traveling wave tube) 60 is directed by a circulator 62 to a 1:m power divider 64. Each of the 'm' outputs of the power divider is connected to an associated input of a Butler matrix via a phase shifter arrangement including a fixed phase shifter 66 and a variable phase shifter 68. Each output of the power divider thus provides an input to a mode input to the Butler matrix 70. In the first mode, the signal applied to the first input is provided at each of 'x' outputs of the Butler matrix 70. The outputs of the Butler matrix circuit are applied to the radiating elements of the cylindrical array 20 via a feed arrangement 80. The feed arrangement 80 is shown more fully in FIG. 6.

Figure 6:
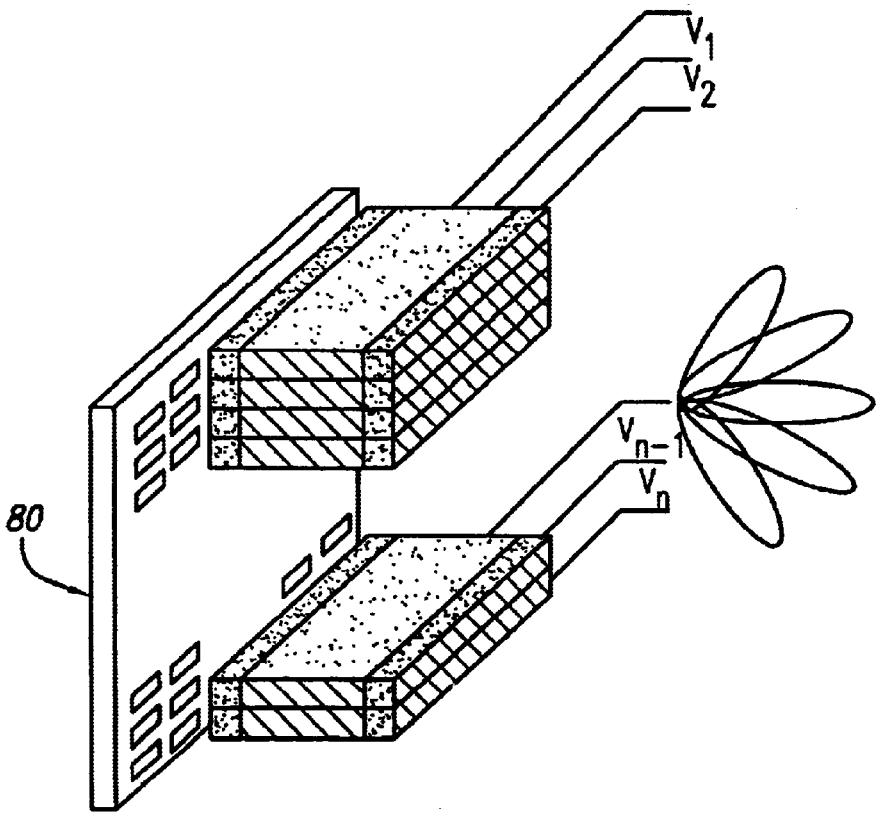
FIG. 6 is a diagram showing a portion of the binary feed of depicted in FIG. 2.

FIG. 6 is a diagram showing a portion of the binary feed of depicted in FIG. 2. In FIG. 6, the binary feed 80 is rotated to show the section of the radiating plates or lens in perspective. The binary feed, may be a corporate feed, simple power divider, series feed or other suitable arrangement. As is evident from FIG. 6, the plates 22, 24, etc. need not be circular or ring-shaped disks. Small, piece-wise rectangular radiating elements could be used around the periphery of a body or housing without departing from the scope of the present teachings.

Figure 7:
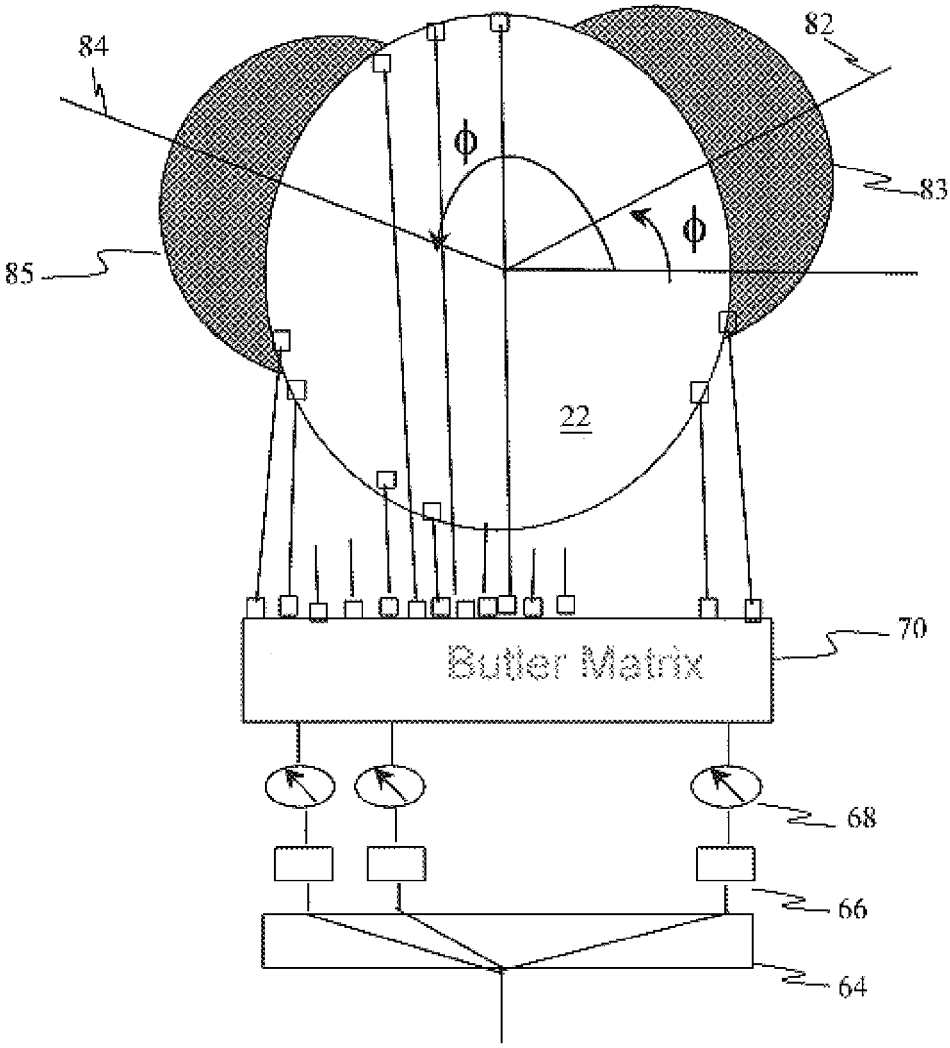
FIG. 7 is a diagram which shows how the Butler matrix is connected to a single radiating element in accordance with the present teachings.

FIG. 7 is a diagram which shows how the Butler matrix is connected to a single radiating element in accordance with the present teachings. In FIG. 7, only nine connections are shown between the Butler matrix 70 and the element 22. In practice, for 360° azimuthal coverage, each of the outputs of the Butler matrix 80 is connected to a corresponding location on the plate 22. Moreover, in the best mode, each output of the Butler matrix 80 is connected to the same location on each of the other radiating elements in the array 20. This is depicted in FIG. 8.

Figure 8:
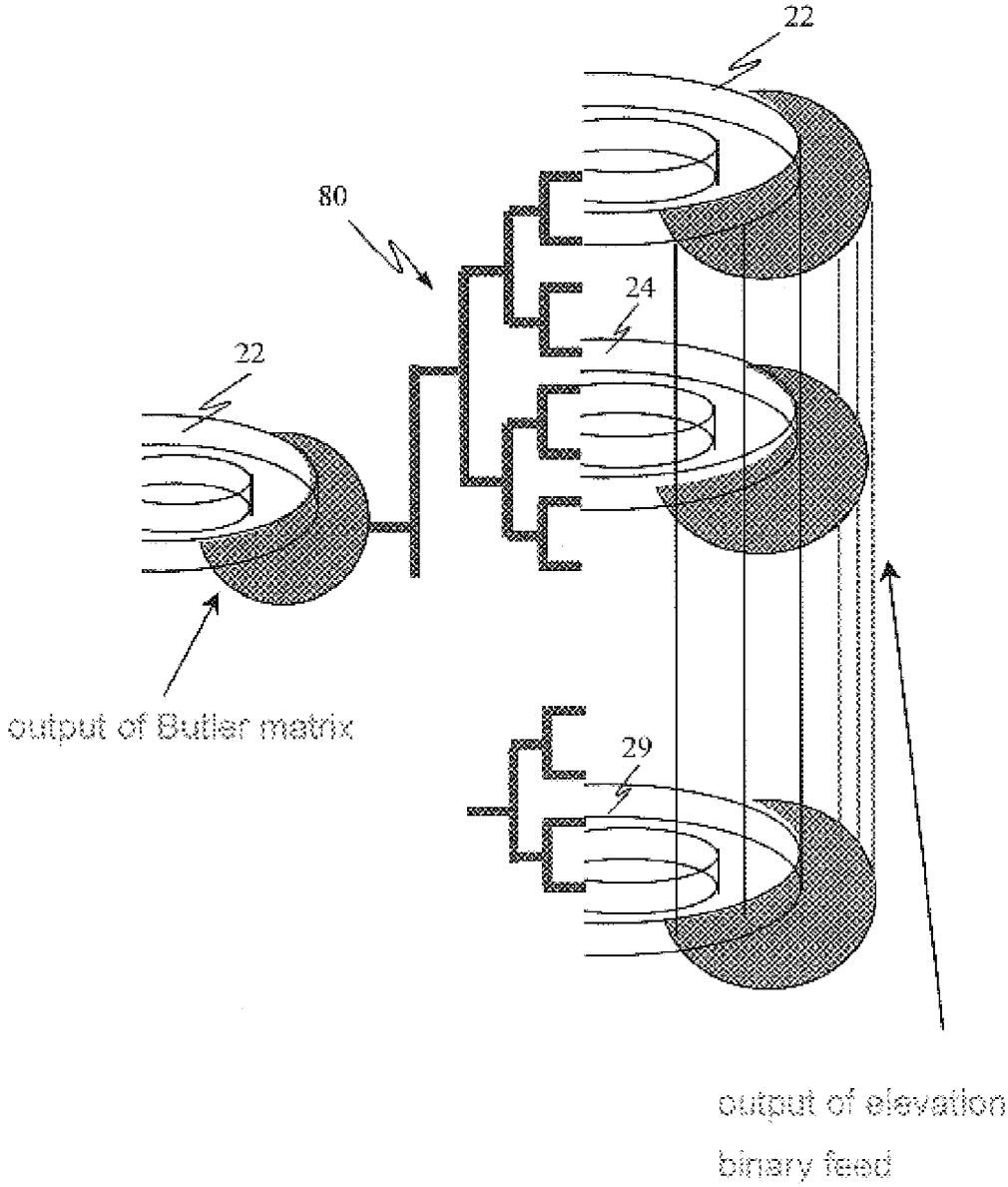
FIG. 8 is a simplified diagram which illustrates an arrangement by which the outputs of the Butler matrix are connected to each of the radiating elements of the array of the antenna of the present invention.

FIG. 8 is a simplified diagram which illustrates an arrangement by which the outputs of the Butler matrix are connected to each of the radiating elements of the array of the antenna of the present invention. As shown in FIG. 8, the Butler matrix converts a two-dimensional (2D) aperture distribution into a three-dimensional (3D) aperture distribution.

With the distribution depicted in FIGS. 7 and 8, a first beam 82, with an associated aperture distribution 83, is generated at a first angle of $\phi_1$ in azimuth by using all the circular mode generated by Butler matrix with proper phase shifter arrangement for each mode and a second beam 84, with an associated aperture distribution 85, is generated at a second angle of $\phi_2$ in azimuth in a second excitation condition. Thus, scanning in azimuth is effected by proper selection of the fixed and variable phase shifters and by applying a signal sequentially to each of the inputs to the Butler matrix.

Hence, azimuth scan is accomplished with the Butler matrix 70 and the variable phase shifters and elevation scan is accomplished with the cylindrical lens electronic scan array (ESA) 20 via a set of variable DC voltage biases. Each input port of the Butler matrix represents a different circular mode on a cylinder. The input and output of the Butler matrix are a discrete Fourier transform pair. Simple superposition of these circular modes provides a desired aperture distribution for an azimuth scan position. The aperture distribution in FIG. 7 indicates that all the energy is distributed only in the desired radiation direction including proper low side lobe taper. By assigning a new set of phases with the variable phase shifters, the same aperture distribution may be freely rotated around the array 20. Each binary feed output spatially or contiguously feeds the input port (inner circle of the cylinder) of lens array 20.

The system controller 40 provides azimuth and elevation scan control signals. Thus, in the illustrative application, the system of FIG. 2 accommodates a seeker 18 located at the nose cone 12 of a missile, without blocking the view of the conical/cylindrical conformal antenna 10.

In short, the system depicted in FIG. 2 can be used for dual mode (IR & RF or RF & RF) seeker. In this embodiment the RF seeker can be either a sequential lobbing or a monopulse approach for target detection.

Figure 9:
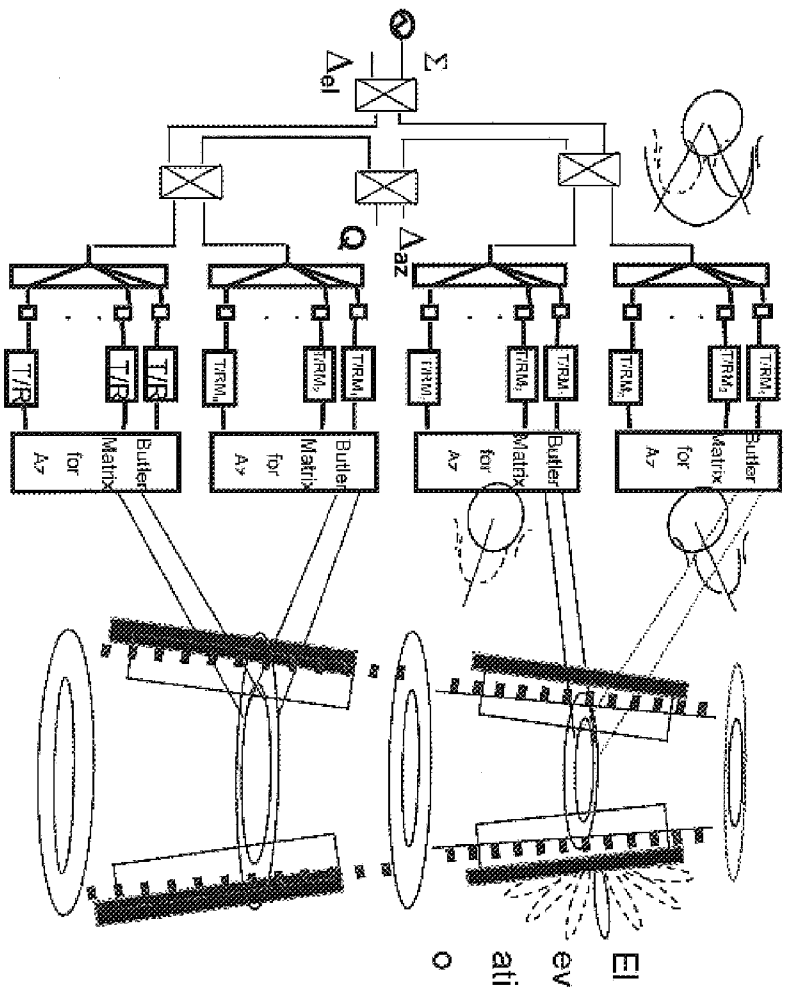
FIG. 9 is a diagram showing a monopulse arrangement with a Butler matrix and a cylindrical lens electronic scan array in accordance with the present teachings.

FIG. 9 is a diagram showing a monopulse arrangement with a Butler matrix and a cylindrical lens electronic scan array in accordance with the present teachings. The monopulse RF seeker can be realized with four Butler matrices with four extra phase shifter sets. The present teachings can be used for a dual mode seeker in an airborne missile, aircraft or stationary tracking system.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. An antenna comprising:

an array including a stack of planar parallel ring-shaped radiating elements, each of the elements being mounted at a predetermined substantially transverse angle relative to a longitudinal axis and a circuit for providing an electrical potential between at least two of the elements effective to scan a transmit or a receive beam of electromagnetic energy along an elevation axis at least substantially transverse to the longitudinal axis.

2. The invention of claim 1 wherein each of the elements is a conductive parallel plate.

3. The invention of claim 1 wherein each of the elements is filled with ferroelectric bulk material.

4. The invention of claim 3 wherein an inner periphery of each element has a space matching for a space fed array with contiguous matching for contiguous fed array material disposed thereon.

5. The invention of claim 4 wherein an outer periphery of each element has a space matching disposed thereon.

6. The invention of claim 1 wherein said antenna is a monopulse arrangement with a Butler matrix and a cylindrical lens electronic scan array.

7. The invention of claim 1 further including a second circuit for exciting at least some of the elements to cause the elements to generate a transmit or a receive beam of electromagnetic energy off-axis relative to the longitudinal axis.

8. The invention of claim 7 wherein the second circuit includes a multi-beam circuit.

9. The invention of claim 8 wherein the multi-beam circuit includes means for exciting the elements to cause the beam to scan in azimuth about the longitudinal axis, the azimuthal axis being at least substantially transverse to the longitudinal axis and the elevational axis.

10. The invention of claim 9 wherein the multi-beam circuit is a Butler matrix.

11. The invention of claim 10 further including a signal source.

12. The invention of claim 11 further including a power divider connected to the source.

13. The invention of claim 12 further including a phase shifting element disposed at each output of the power divider and connected between the power divider and the Butler matrix.

14. The invention of claim 13 further including a variable phase shifter connected between the power divider and the Butler matrix.

15. The invention of claim 10 further including a feed network connected between the Butler matrix and the array.

16. The invention of claim 15 wherein the feed network is a binary feed.

17. An antenna comprising:

a body fixed phased array of stacked planar, parallel, ring-shaped radiating elements, each of the elements being a conductive plate mounted at a predetermined substantially transverse angle relative to a longitudinal axis;

a first circuit for providing an electrical potential between at least two of the elements effective to scan a transmit or a receive beam of electromagnetic energy along an elevation axis at least substantially transverse to the longitudinal axis; and a second circuit for exciting at least some of the elements to cause the elements to generate a transmit or a receive beam of electromagnetic energy off-axis relative to the longitudinal axis.

18. The invention of claim 17 wherein the first circuit includes a microprocessor.

19. The invention of claim 18 wherein the first circuit further includes a power divider network for providing a voltage differential between selective radiating elements.

20. The invention of claim 17 wherein the second circuit includes a multi-beam circuit.

21. The invention of claim 20 wherein the multi-beam circuit includes means for exciting the elements to cause the beam to scan in azimuth about the longitudinal axis, the azimuthal axis being at least substantially transverse to the longitudinal axis and the elevational axis.

22. The invention of claim 21 wherein the multi-beam circuit is a Butler matrix.

23. The invention of claim 22 further including a signal source.

24. The invention of claim 23 further including a power divider connected to the source.

25. The invention of claim 24 further including a phase shifting element disposed at each output of the power divider and connected between the power divider and the Butler matrix.

26. The invention of claim 25 further including a variable phase shifter connected between the power divider and the Butler matrix.

27. The invention of claim 22 further including a feed network connected between the Butler matrix and the array.

28. The invention of claim 27 wherein the feed network is a binary feed.

29. The invention of claim 17 wherein each of the elements is filled with ferroelectric bulk material.

30. The invention of claim 29 wherein an inner periphery of each element has a space matching material disposed thereon.

31. The invention of claim 30 wherein an outer periphery of each element has a space matching disposed thereon.

32. A method for radiating electromagnetic energy including the steps of:

providing an array of radiating elements, each of the elements being mounted at a predetermined substantially transverse angle relative to a longitudinal axis;

providing an electrical potential between at least two of the elements effective to scan a transmit or a receive beam of electromagnetic energy along an elevation axis at least substantially transverse to the longitudinal axis;

exciting at least some of the elements to cause the elements to generate a transmit or a receive beam of electromagnetic energy off-axis relative to the longitudinal axis; and exciting at least some of the elements to cause the beam to scan in azimuth.

33. An antenna comprising:

an array of radiating elements, each of the elements being mounted at a predetermined substantially transverse angle relative to a longitudinal axis and being filled with ferroelectric bulk material and a circuit for providing an electrical potential between at least two of the elements effective to scan a transmit or a receive beam of electromagnetic energy along an elevation axis at least substantially transverse to the longitudinal axis.

34. A monopulse antenna comprising:

a cylindrical lens electronic scan array of radiating elements, each of the elements being mounted at a predetermined substantially transverse angle relative to a longitudinal axis and a Butler matrix for providing an electrical potential between at least two of the elements effective to scan a transmit or a receive beam of electromagnetic energy along an elevation axis at least substantially transverse to the longitudinal axis.

35. An antenna comprising:

an array of radiating elements, each of the elements being mounted at a predetermined substantially transverse angle relative to a longitudinal axis;

a first circuit for providing an electrical potential between at least two of the elements effective to scan a transmit or a receive beam of electromagnetic energy along an elevation axis at least substantially transverse to the longitudinal axis; and a second circuit for exciting at least some of the elements to cause the elements to generate a transmit or a receive beam of electromagnetic energy off-axis relative to the longitudinal axis, said second circuit including a multi-beam circuit, said multi-beam circuit including means for exciting the elements to cause the beam to scan in azimuth about the longitudinal axis, the azimuthal axis being at least substantially transverse to the longitudinal axis and the elevational axis.

36. The invention of claim 35 wherein the multi-beam circuit is a Butler matrix.

37. The invention of claim 36 further including a signal source.

38. The invention of claim 37 further including a power divider connected to the source.

39. The invention of claim 38 further including a phase shifting element disposed at each output of the power divider and connected between the power divider and the Butler matrix.

40. The invention of claim 39 further including a variable phase shifter connected between the power divider and the Butler matrix.

41. The invention of claim 36 further including a feed network connected between the Butler matrix and the array.

42. The invention of claim 41 wherein the feed network is a binary feed.

43. A system for radiating electromagnetic energy including:

means for providing an array of radiating elements, each of the elements being mounted at a predetermined substantially transverse angle relative to a longitudinal axis;

means for providing an electrical potential between at least two of the elements effective to scan a transmit or a receive beam of electromagnetic energy along an elevation axis at least substantially transverse to the longitudinal axis; and means for exciting at least some of the elements to cause the elements to generate a transmit or a receive beam of electromagnetic energy off-axis relative to the longitudinal axis, said means for exciting further including means for exciting at least some of the elements to cause the beam to scan in azimuth.

* * * * *